US010045102B2

(12) United States Patent
Yokohama

(10) Patent No.: US 10,045,102 B2
(45) Date of Patent: Aug. 7, 2018

(54) SPEAKER DEVICE

(71) Applicant: CITYFOREST WORKERS NET CO., LTD., Suzuka-shi, Mie (JP)

(72) Inventor: Kinpei Yokohama, Mie (JP)

(73) Assignee: CITYFOREST WORKERS NET CO., LTD., Mie (JP)

( * ) Notice: Subject to any disclaimer, the term of this patent is extended or adjusted under 35 U.S.C. 154(b) by 0 days.

(21) Appl. No.: 15/318,656

(22) PCT Filed: Oct. 28, 2015

(86) PCT No.: PCT/JP2015/005414
§ 371 (c)(1),
(2) Date: Dec. 13, 2016

(87) PCT Pub. No.: WO2017/072814
PCT Pub. Date: May 4, 2017

(65) Prior Publication Data

US 2017/0289659 A1 Oct. 5, 2017

(51) Int. Cl.
*H04R 9/06* (2006.01)
*H04R 1/02* (2006.01)
(Continued)

(52) U.S. Cl.
CPC ..... *H04R 1/025* (2013.01); *H04R 7/16* (2013.01); *H04R 9/06* (2013.01); *H04R 9/025* (2013.01)

(58) Field of Classification Search
CPC ..... H04R 1/16; H04R 11/02; H04R 2307/021
See application file for complete search history.

(56) References Cited

U.S. PATENT DOCUMENTS 1,630,009 A 5/1927 Hopkins
1,748,632 A * 2/1930 Boxley ..... H04R 7/122 181/171
(Continued)

FOREIGN PATENT DOCUMENTS

GB 320748 A * 10/1929 ..... H04R 7/12
JP 2000350285 A * 12/2000
(Continued)

OTHER PUBLICATIONS

Supplementary European Search Report for the Application No. EP 15 89 4510 dated Jun. 16, 2017.
(Continued)

*Primary Examiner* — Matthew Eason
*Assistant Examiner* — Ryan Robinson
(74) *Attorney, Agent, or Firm* — Cheng Law Group, PLLC

(57) ABSTRACT

A speaker device includes a vibration generator, a rod-like member, and a sound generator. The vibration generator vibrates when receiving an electrical signal. The rod-like member has a first longitudinal end fixed to the vibration generator. The sound generator is attached to a part of the rod-like member. The sound generator integrally includes a vibration transmitter which has a fibrous structure and a diaphragm which is a sheet and has a fibrous structure. When a fiber direction is defined as a direction in which fibers of a fibrous structure are oriented, a fiber direction of the vibration transmitter and a fiber direction of the diaphragm intersect with each other.

10 Claims, 5 Drawing Sheets

(51) Int. Cl.
*H04R 7/16* (2006.01)
*H04R 9/02* (2006.01)

(56) References Cited

U.S. PATENT DOCUMENTS

| | | | | | |
|---|---|---|---|---|---|
| 1,749,635 | A * | 3/1930 | Gerlach | H04R 7/14 | 381/152 |
| 1,756,838 | A | 4/1930 | Staunton | | |
| 1,767,777 | A | 6/1930 | Thomas | | |
| 1,827,919 | A * | 10/1931 | Wagenen | H04R 11/02 | 381/411 |
| 1,859,921 | A * | 5/1932 | Heising | H04R 7/12 | 181/171 |
| 6,044,159 | A * | 3/2000 | Schmertmann | H04R 7/04 | 381/186 |
| 8,073,162 | B2 * | 12/2011 | Ando | H04R 1/403 | 381/152 |
| 8,577,076 | B2 * | 11/2013 | Ohashi | H04R 1/028 | 381/349 |
| 9,055,358 | B2 * | 6/2015 | Sato | H04R 1/02 | |
| 2009/0169047 | A1 | 7/2009 | Ando | | |
| 2014/0341401 | A1 | 11/2014 | Sato et al. | | |
| 2016/0353206 | A1 * | 12/2016 | Stahl | H04R 7/04 | |

FOREIGN PATENT DOCUMENTS

| | | | |
|---|---|---|---|
| JP | 2008-66959 | A | 3/2008 |
| JP | 2009-159248 | A | 7/2009 |
| JP | 2014-225734 | A | 12/2014 |
| JP | 2015-156605 | A | 8/2015 |

OTHER PUBLICATIONS

International Search Report for the Application No. PCT/JP2015/005414 dated Dec. 15, 2015.

"Sound-Closable Speaker Closing Hinoki-made leaves will . . . " The Asahi Shimbun Digital [online], Oct. 7, 2014, [Date of search Nov. 21, 2015] Internet <URL:https://web.archive.org/web/20141007185419/http://www.asahi.com/articles/ASG9T43P6G9TONFBOOL.html>.

"Woody Scent, Profound Sound Speaker in Storehouse Matsusaka, Mie", The Asahi Shimbun Digital [online], May 1, 2013, [Date of search Nov. 27, 2015] Internet <URL:https://web.archive.org/web/20130501060743/http://www.asahi.com/area/mie/articles/NGY201304110022.html>.

* cited by examiner

SPEAKER DEVICE

TECHNICAL FIELD

The present invention relates to speaker devices.

BACKGROUND ART

JP2009-159248 A discloses a speaker. In the disclosed speaker, vibration generated in a sound source is transmitted to wing members through a rod-like member. Accordingly, sound is emitted from the wing members.

SUMMARY OF INVENTION

The present invention aims to provide a speaker device having an improved sound quality.

A speaker device according to one embodiment of the present invention includes a vibration generator, a rod-like member, and a sound generator. The vibration generator vibrates when receiving an electrical signal. The rod-like member has a first longitudinal end fixed to the vibration generator. The sound generator is attached to a part of the rod-like member. The sound generator integrally includes a vibration transmitter which has a fibrous structure and a diaphragm which is a sheet and has a fibrous structure. When a fiber direction is defined as a direction in which fibers of a fibrous structure are oriented, a fiber direction of the vibration transmitter and a fiber direction of the diaphragm intersect with each other.

DESCRIPTION OF EMBODIMENTS

FIG. 1 to FIG. 4 illustrates a speaker device according to a first embodiment of the present invention.

Figure 1:
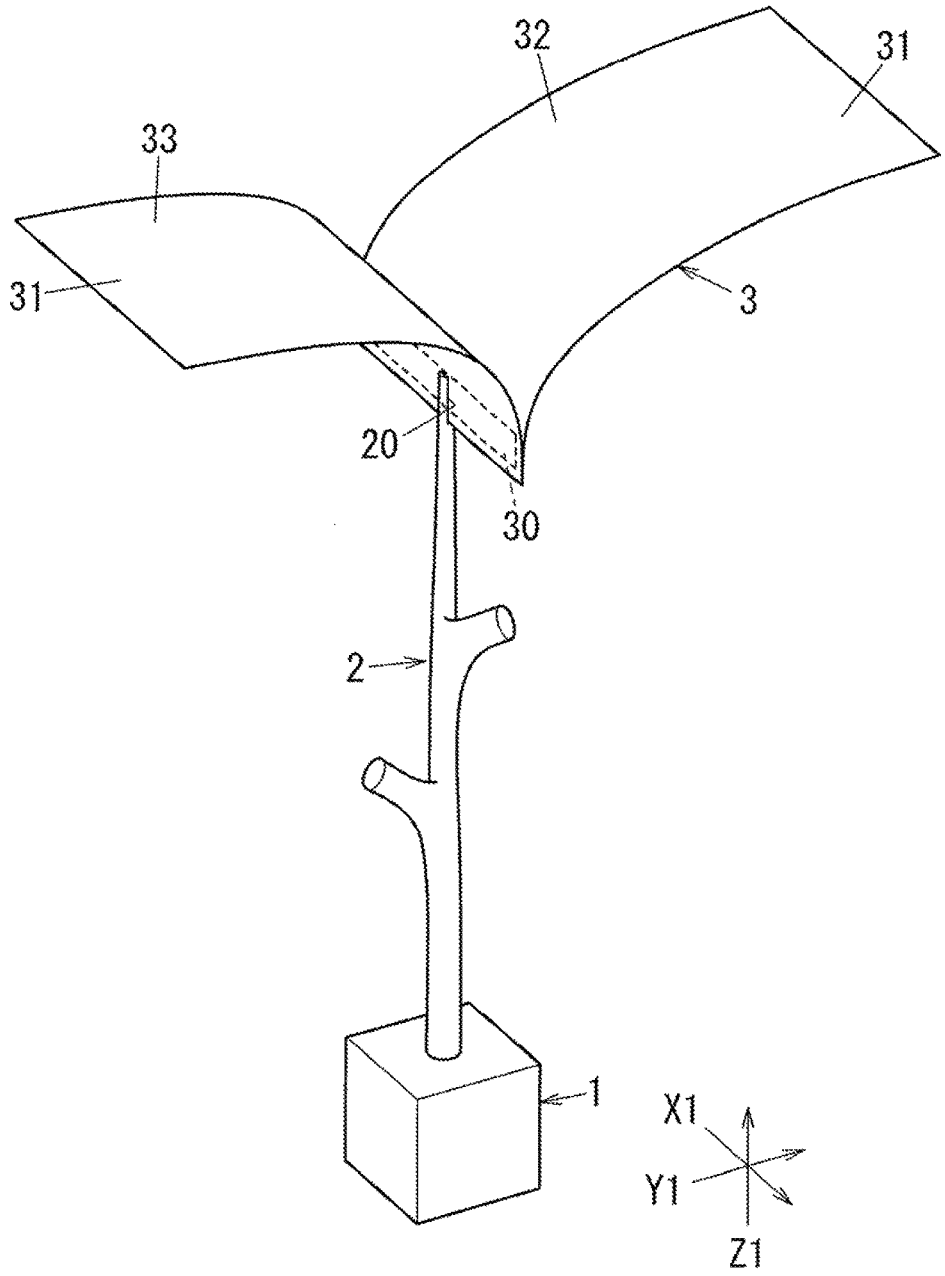
FIG. 1 is a perspective view illustrating a speaker device of a first embodiment.

As illustrated in FIG. 1, the speaker device of the present embodiment includes a vibration generator 1, a rod-like member 2, and a sound generator 3. The vibration generator 1 vibrates when receiving an electrical signal. The rod-like member 2 has a first longitudinal end fixed to the vibration generator 1. The sound generator 3 is attached to a part of the rod-like member 2.

Each component of the speaker device will be explained hereinafter, referring to FIG. 1 as a standard state of the speaker device. In FIG. 1, a longitudinal direction of the rod-like member 2 is defined as a vertical direction, and a longitudinal direction of the sound generator 3 in a plan view is defined as a right-and-left direction, and a transverse direction of the sound generator 3 in a plan view is defined as a back-and-forth direction. In each of the figures, an arrow X1 is directed forward, an arrow Y1 is directed to right, and an arrow Z1 is directed upward.

Figure 4:
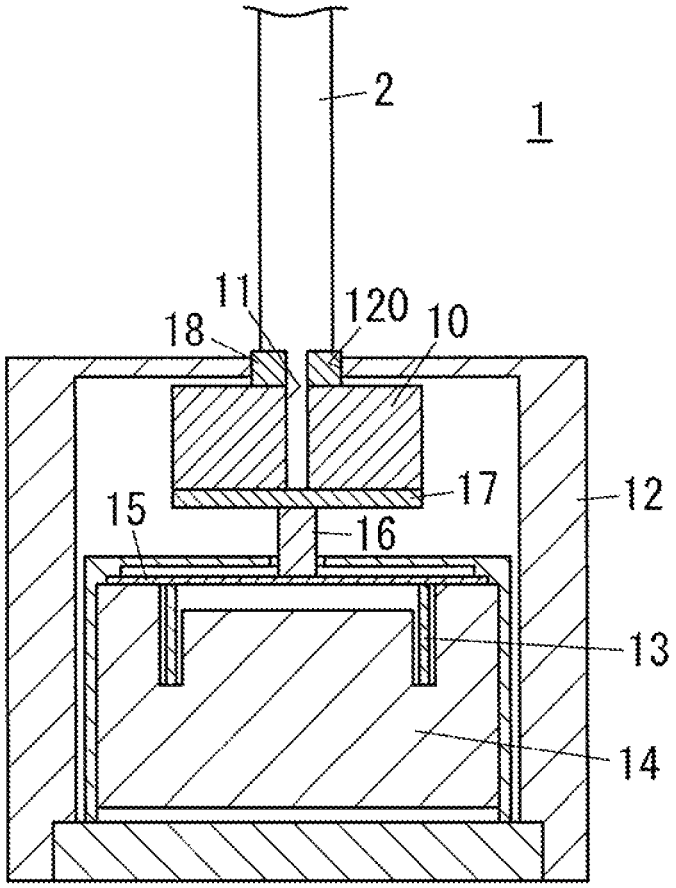
FIG. 4 is a cross sectional view schematically illustrating a vibration generator in the speaker device of the first embodiment.

The rod-like member 2 has a fibrous structure. A fiber direction of the rod-like member 2 is the longitudinal direction thereof. A fiber direction is defined as a direction in which fibers of a fibrous structure are oriented. In the present embodiment, the rod-like member 2 is made of dried wood which is a branch of a tree. Note that, the dried wood means a wood material dried up to an equilibrium moisture content. A bottom end of the rod-like member 2 is fixed to the vibration generator 1 in a detachable manner. As illustrated in FIG. 4, the bottom end of the rod-like member 2 has a shape corresponding to a shape of an insertion hole 11 provided to a fixer 10 included in the vibration generator 1. The rod-like member 2 includes a groove 20 at its top end (a second longitudinal end). The sound generator 3 is attached to the groove 20 in a detachable manner. In the rod-like member 2, the bottom end serves as a fixed end and the top end serves as a free end. The fixed end is fixed to the vibration generator 1, and the sound generator 3 is attached to the free end.

Figure 2:
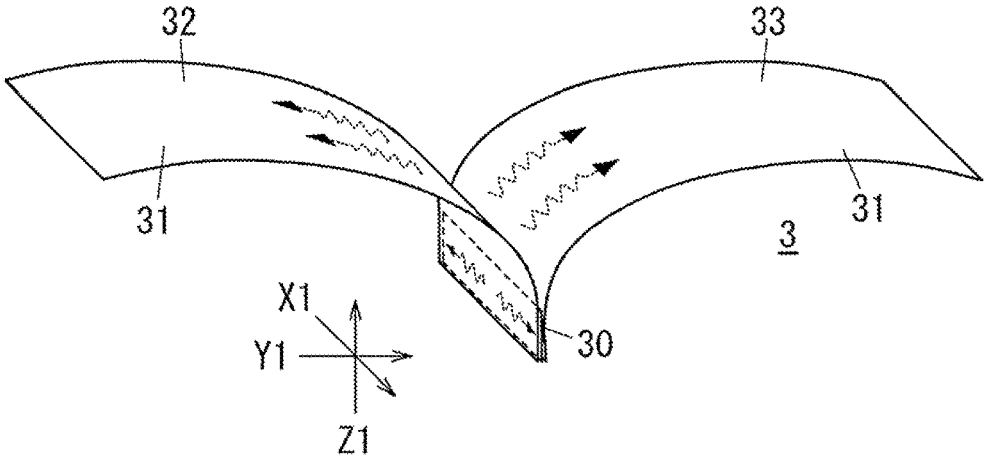
FIG. 2 is a perspective view illustrating a sound generator in the speaker device of the first embodiment.

As illustrated in FIG. 1 and FIG. 2, the sound generator 3 integrally includes a vibration transmitter 30 which has a fibrous structure and a diaphragm 31 which is a sheet and has a fibrous structure. A fiber direction of the vibration transmitter 30 and a fiber direction of the diaphragm 31 intersect with each other.

The vibration transmitter 30 is a thin plate, and the fiber direction of the vibration transmitter 30 is a longitudinal direction thereof. In the present embodiment, the vibration transmitter 30 is a rectangular thin plate. For example, the vibration transmitter 30 is made of a thin slice of solid wood dried up to an equilibrium moisture content. A longitudinal length of the vibration transmitter 30 is substantially same as a transverse length of the diaphragm 31. A transverse length of the vibrations transmitter 30 is substantially same as a depth (a length in a vertical direction) of the groove 20. A thickness of the vibration transmitter 30 is, for example, 0.2 to 2.0 mm.

The diaphragm 31 includes a first flexible sheet 32 having a fibrous structure and a second flexible sheet 33 having a fibrous structure. One end of the first flexible sheet 32 in a fiber direction thereof, one end of the second flexible sheet 33 in a fiber direction thereof, and the vibration transmitter 30 are overlapping. In the present embodiment, the vibration transmitter 30 is disposed between the one end of the first flexible sheet 32 in the fiber direction thereof and the one end of the second flexible sheet 33 in the fiber direction thereof and bonded to each attic first flexible sheet 32 and the second flexible sheet 33.

Each of the first flexible sheet 32 and the second flexible sheet 33 is rectangular, and the fiber directions of the first flexible sheet 32 and the second flexible sheet 33 are longitudinal directions of the first flexible sheet 32 and the second flexible sheet 33, respectively. In the present embodiment, the first flexible sheet 32 and the second flexible sheet 33 have same shapes and sizes with each other.

Figure 3:
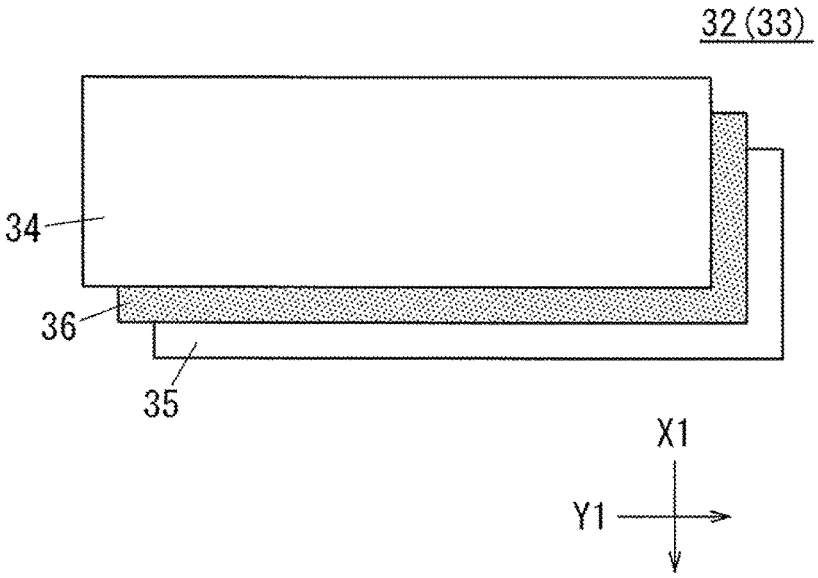
FIG. 3 is a disassembled view of a flexible sheet in the speaker device of the first embodiment.

As illustrated in FIG. 3, each of the first flexible sheet 32 and the second flexible sheet 33 includes a pair of wooden sheets 34, 35 and washi 36 which is a piece of Japanese paper.

Each of the pair of wooden sheets 34, 35 is rectangular, and fiber directions of the pair of wooden sheets 34, 35 are longitudinal directions of the pair of wooden sheets 34, 35, respectively. For example, each of the pair of wooden sheets 34, 35 is made of a thin, such as about 0.2 mm, slice of solid wood dried up to an equilibrium moisture content. The longitudinal direction of each of the pair of wooden sheets 34, 35 corresponds to the right-and-left direction and a transverse direction of each of the pair of wooden sheets 34, 35 corresponds to the back-and-forth direction.

The washi 36 is rectangular. The washi 36 has the substantially same length in the right-and-left direction and the substantially same length in the back-and-forth direction as the pair of wooden sheets 34, 35. The washi 36 is disposed between the pair of wooden sheets 34, 35 and bonded to each of the pair of wooden sheets 34, 35.

Each of the flexible sheets 32, 33 is formed by disposing the washi 36, which is provided with bonding layers on both surfaces thereof, between the pair of wooden sheets 34, 35, and then pressing them by a heat press roller. During this process, the pair of wooden sheets 34, 35 is overlapped such that the fiber directions of the pair of wooden sheets 34, 35 are substantially parallel with each other. A thickness of each of the flexible sheets 32, 33 is, for example, 0.4 mm to 2.0 mm.

The vibration generator 1 is a device which vibrates when receiving an electrical signal, and may be a well-known actuator or the like.

As illustrated in FIG. 4, the vibration generator 1 includes a case 12, a coil 13, a magnet 14, a cap 15, a driving member 16, an amplification plate 17, the fixer 10, and an elastic member 18 which is ring-shaped. The coil 13 is fixed at a bottom surface of the cap 15, and the driving member 16 is fixed at a top surface of the cap 15. The amplification plate 17 is fixed at a top end of the driving member 16, and the fixer 10 is fixed at a top surface of the amplification plate 17. The coil 13, the cap 15, the driving member 16, the amplification plate 17, and the fixer 10 are integrated such that central axes of the coil 13, the cap 15, the driving member 16, the amplification plate 17, and the fixer 10 fall in the same line or in the substantially same line. The insertion hole 11 is positioned on the central axis of the fixer 10. The case 12 is provided with a through hole 120 into which the bottom end of the rod-like member 2 is inserted. The elastic member 18 which is ring-shaped is embedded in the through hole 120.

In the vibration generator 1, when an electrical signal is supplied from an external output device, an electric current corresponding to the electrical signal flows through the coil 13, and the coil 13 vibrates up and down under an influence by a magnetic field due to the magnet 14. Vibration of the coil 13 is transmitted to the driving member 16 via the cap 15, and vibration of the driving member 16 is transmitted to the amplification plate 17. Vibration transmitted to the amplification plate 17 is amplified by the amplification plate 17 and then transmitted to the fixer 10. Vibration of the fixer 10 is transmitted to the rod-like member 2. Since the rod-like member 2 and the vibration generator 1 are fixed such that central axes of the rod-like member 2 and the vibration generator 1 fall in the same line or in the substantially same line, the vibration generated by the vibration generator 1 is efficiently transmitted all the way to the rod-like member 2.

The speaker device according to the present embodiment explained above can be assembled and used, for example, as following.

First, the bottom end of the rod-like member 2 is inserted to the insertion hole 11 of the fixer 10 in the vibration generator 1 so that the rod-like member 2 is fixed to the vibration generator 1.

Next, a part of the sound generator 3 is inserted in the groove 20 at the top end of the rod-like member 2 so that the sound generator 3 is attached to the rod-like member 2. In this process, the one end of the first flexible sheet 32 in the fiber direction thereof, the one end of the second flexible sheet 33 in the fiber direction thereof, and the vibration transmitter 30 are disposed in the groove 20.

Then, a shape of each of the flexible sheets 32, 33 may be modified to a desirable shape. In the present embodiment, the shape of each of the flexible sheets 32, 33 changes to a substantially circular arc shape protruding upward due to its own weight.

Next, when an electrical signal is sent from the external output device to the vibration generator 1 to vibrate the vibration generator 1, sound is generated by the sound generator 3. The external output device may be an amplifier for audio equipment, a personal computer, a TV, a portable music player, a cell phone, a smartphone, or the like.

In the speaker device according to the present embodiment explained above, as illustrated in FIG. 2, the sound generator 3 integrally includes the vibration transmitter 30 and the flexible sheets 32, 33, and the vibration transmitter 30 and the flexible sheets 32, 33 are overlapping such that the fiber direction of the vibration transmitter 30 and the fiber direction of each of the flexible sheets 32, 33 intersect with each other. Accordingly, vibration transmitted from the rod-like member 2 is efficiently spread via the vibration transmitter 30 in a direction intersecting with the fiber direction of each of the flexible sheets 32, 33 (the back-and-forth direction). Vibration spread via the vibration transmitter 30 is further spread out in the fiber direction of each of the flexible sheets 32, 33 (the right-and-left direction). Therefore, in the speaker device according to the present embodiment, vibration tends to spread easily throughout each of the flexible sheets 32, 33, and sound can be emitted from a broad region, leading to an improved sound quality.

Furthermore, in the speaker device according to the present embodiment, a part of the sound generator 3 at which the vibration transmitter 30 is positioned is attached to the groove 20 of the rod-like member 1. Accordingly, vibration transmitted from the rod-like member 2 is spread out quickly in the back-and-forth direction via the vibration transmitter 30. Consequently, in the speaker device according to the present embodiment, vibration is spread out efficiently throughout the flexible sheets 32, 33.

Moreover, in the speaker device according to the present embodiment, each of the flexible sheets 32, 33 can warp. Since each of the flexible sheets 32, 33 warps, an internal loss increases, leading to a high sound quality.

In addition, in the speaker device according to the present embodiment, the pair of wooden sheets 34, 35 is reinforced with the washi 36. Accordingly, damages to each of the pair of wooden sheets 34, 35 due to vibration are suppressed. Also, damages to each of the pair of wooden sheets 34, 35 due to modifications of the shapes of the flexible sheets 32, 33 are suppressed. Further, since the pair of wooden sheets 34, 35 is reinforced with the washi 36, a warp of each of the flexible sheets 32, 33 due to its own weight is maintained appropriately. An appropriate internal loss can be gained by virtue of an appropriate warp.

Further, in the speaker device according to the present embodiment, sound can be emitted from both of a front surface (a top surface) and a back surface (a bottom surface) of each of the flexible sheets 32, 33.

Also, in the speaker device according to the present embodiment, since the fiber direction of the rod-like member 2 is the longitudinal direction thereof, vibration from the vibration generator 1 tends to easily be transmitted from a first longitudinal end, which is a longitudinal end opposite of the second longitudinal end, to the second longitudinal end of the rod-like member 2.

Moreover, in the rod-like member 2 of the speaker device according to the present embodiment, the first longitudinal end serves as the fixed end and the second longitudinal end serves as the free end. The fixed end is fixed to the fixer 10 of the vibration generator 1, and the sound generator 3 is attached to the free end. Accordingly, in the speaker device according to the present embodiment, vibration generated in the vibration generator 1 can be amplified by the rod-like member 2 and then transmitted to each of the flexible sheets 32, 33.

Furthermore, in the speaker device according to the present embodiment, since both of the rod-like member 2 and the sound generator 3 are made of natural fibrous materials, sound having less high frequency component can be generated.

Modified examples of the speaker device according to the present embodiment are explained hereinafter.

The rod-like member 2 of the speaker device according to the present embodiment may be made of another natural fibrous material having a fibrous structure, which may include: a stem, a leaf, a branch, and an epidermis of a plant; solid wood; and a bamboo. The rod-like member 2 may be a member of the above natural fibrous material reinforced with a core of metal or plastic. The rod-like member 2 may be a member of laminated wood, plywood, or wood fiberboard formed into a rod. The rod-like member 2 may be a member of carbon fibers or glass fibers such as FRP reinforced and formed into a rod or a member of paper or a textile reinforced and formed into a rod.

The sound generator 3 of the speaker device according to the present embodiment may be attached to a part of the rod-like member 2 other than the groove 20.

The sound generator 3 of the speaker device according to the present embodiment may have a structure in which one ends of the flexible sheets 32, 33 in fiber directions thereof overlap with each other and the vibration transmitter 30 is disposed on an outer side of the one end, in the fiber direction, of one of the flexible sheets 32, 33.

A part of the sound generator 3 of the speaker device according to the present embodiment at which the vibration transmitter 30 is not positioned may be attached to the rod-like member 2.

Each of the flexible sheets 32, 33 of the speaker device according to the present embodiment may have a structure in which a plastic thin plate or a metal thin plate is bonded to a sheet having a fibrous structure. Materials for the rod-like member 2 mentioned above are applicable as the sheet having a fibrous structure.

The shape of each of the flexible sheets 32, 33 of the speaker device according to the present embodiment is not limited to a rectangular shape, but may be other shapes such as a half elliptical shape.

Figure 5:
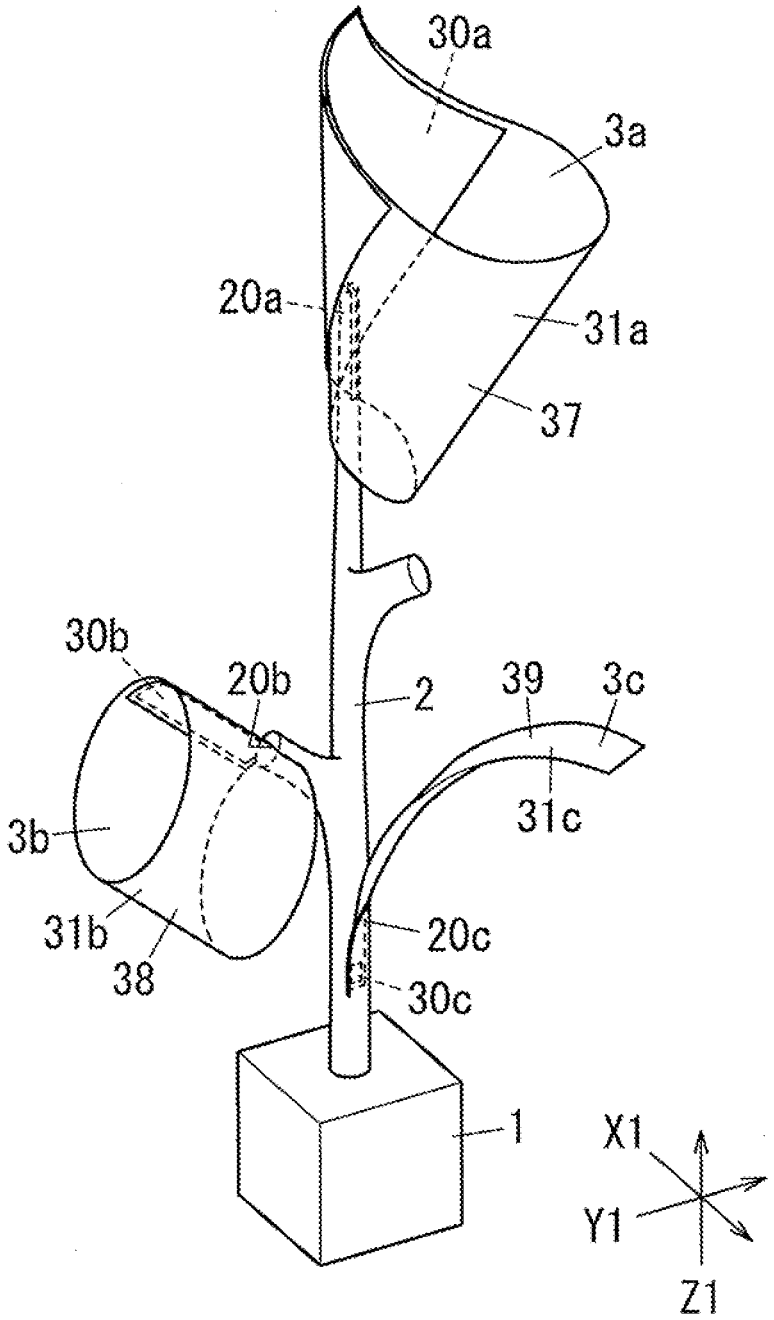
FIG. 5 is a perspective view illustrating a speaker device of a second embodiment.
Figure 6:
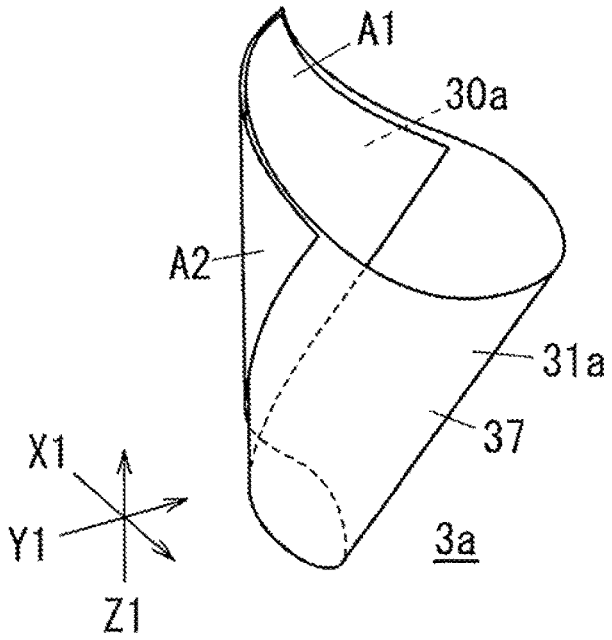
FIG. 6 is a perspective view illustrating a first sound generator in the speaker device of the second embodiment.
Figure 7:
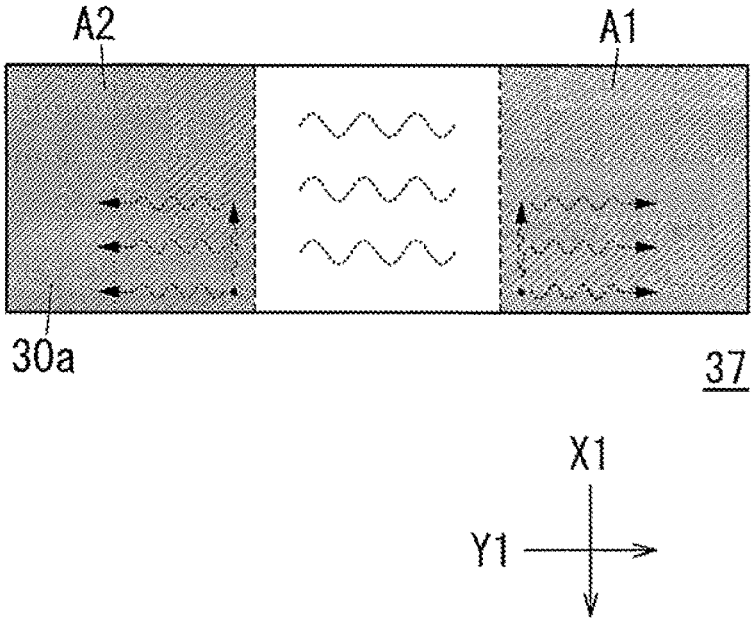
FIG. 7 is a plan view illustrating a flexible sheet in the first sound generator.

A speaker device according to a second embodiment of the present invention as illustrated in FIGS. 5 to 7 is explained hereinafter. In the following explanation, with regard to components of the speaker device according to the second embodiment which are same as the components of the speaker device according to the first embodiment, the same reference signs are used in the figures and detailed explanations are omitted. Detailed explanations are given on components of the speaker device according to the second embodiment which are different from the components of the speaker device according to the first embodiment.

A rod-like member 2 of the speaker device according to the present embodiment includes multiple grooves. The multiple grooves include a first groove 20*a*, a second groove 20*b*, and a third groove 20*c*. The first groove 20*a* is formed at a top end attic rod-like member 2. The second groove 20*b* is formed at a lower part of the rod-like member 2 than the part at which the first groove 20*a* is formed. The third groove 20*c* is formed at a lower part of the rod-like member 2 than the part at which the second groove 20*b* is formed.

The speaker device according to the present embodiment includes multiple sound generators. The multiple sound generators include: a first sound generator 3*a* which has a cylindrical shape, a second sound generator 3*b* which has a cylindrical shape, and a third sound generator 3*c* which has a belt-like shape. The first sound generator 3*a* has a truncated cone shape with its circular top and its circular bottom being open. The second sound generator 3*b* has a columnar shape (a cylindrical shape) with its circular top and its circular bottom being open.

The first sound generator 3*a* integrally includes a vibration transmitter 30*a* which has a fibrous structure and a diaphragm 31*a* which is a sheet and has a fibrous structure. The diaphragm 31*a* includes one flexible sheet 37 having a fibrous structure. The flexible sheet 37 has the same structure as the flexible sheets 32, 33 in the first embodiment. In the first sound generator 3*a*, one part of the flexible sheet 37 and a different part of the flexible sheet 37 are overlapping such that a fiber direction of the one part of the flexible sheet 37 and a fiber direction of the different part of the flexible sheet 37 intersect with each other. The different part of the flexible sheet 37 constitutes the vibration transmitter 30*a*.

The vibration transmitter 30*a* is explained in further detail hereinafter. As illustrated in FIG. 6 and FIG. 7, the flexible sheet 37 includes a square region A1 and a square region A2. One of short sides of the flexible sheet 37 is one of sides of the square region A1, and the other of the short sides of the flexible sheet 37 is one of sides of the square region A2. The entire region A1 and the entire region A2 overlaps such that a fiber direction of the region A1 and a fiber direction of the region A2 intersect with each other. In this state, one of the region A1 and the region A2 constitutes the vibration transmitter 30*a*.

The region A1 and the region A2 may overlap partially. A first region at one longitudinal end of the flexible sheet 37 and a second region at the other longitudinal end of the flexible sheet 37 may overlap in any manner as long as a fiber direction of the first region and a fiber direction of the second region intersect with each other.

A part of the first sound generator 3*a* where the region A1 and the region A2 are overlapping is inserted in the first groove 20*a*. In other words, a part of the first sound generator 3*a* at which the vibration transmitter 30*a* is positioned is inserted in the first groove 20*a*.

As illustrated in FIG. 5, the second sound generator 3*b* integrally includes a vibration transmitter 30*b* which has a fibrous structure and a diaphragm 31*b* which is a sheet and has a fibrous structure. The diaphragm 31*b* includes one flexible sheet 38 having a fibrous structure. The flexible sheet 38 has the same structure as the flexible sheet 37. The vibration transmitter 30*b* is a separate body from the flexible sheet 38.

In the second sound generator 3*b*, one longitudinal end part and the other longitudinal end part of the flexible sheet 38 are overlapping such that a fiber direction of the one longitudinal end part and a fiber direction of the other longitudinal end part are parallel to each other. The vibration transmitter 30*b* is sandwiched between the one longitudinal end part and the other longitudinal end part of the flexible sheet 38. The vibration transmitter 30*b* and the flexible sheet 38 are overlapping such that a fiber direction of the vibration transmitter 30*b* and a fiber direction of the flexible sheet 38 intersect with each other.

At a part of the second sound generator 3*b*, the one longitudinal end part of the flexible sheet 38, the other longitudinal end part of the flexible sheet 38, and the vibration transmitter 30*b* are overlapping. This overlapping part of the second sound generator 3*b* is inserted in the second groove 20*b*. In other words, a part of the second sound generator 3*b* at which the vibration transmitter 30*b* is positioned is inserted in the second groove 20*b*.

The third sound generator 3*c* integrally includes a vibration transmitter 30*c* which has a fibrous structure and a diaphragm 31*c* which is a sheet and has a fibrous structure. The diaphragm 31*c* includes one flexible sheet 39 which has a belt-like shape and a fibrous structure. The flexible sheet 39 has the same structure as the flexible sheets 37, 38. The vibration transmitter 30*c* is a separate body from the flexible sheet 39.

In the third sound generator 3*c*, the vibration transmitter 30*c* and one longitudinal end of the flexible sheet 39 are overlapping such that a fiber direction of the vibration transmitter 30*c* and a fiber direction of the one longitudinal end of the flexible sheet 39 intersect with each other.

A part of the third sound generator 3*c* where the one longitudinal end of the flexible sheet 39 and the vibration transmitter 30*c* are overlapping is inserted in the third groove 20*c*. In other words, a part of the third sound generator 3*c* at which the vibration transmitter 30*c* is positioned is inserted in the third groove 20*c*.

As described above, in the speaker device according to the present embodiment, the three sound generators 3*a*, 3*b*, 3*c* integrally include the vibration transmitters 30*a*, 30*b*, 30*c* and the flexible sheets 37, 38, 39 respectively, and the vibration transmitters 30*a*, 30*b*, 30*c* and the flexible streets 37, 38, 39 are overlapping respectively such that the fiber directions of the vibration transmitters 30*a*, 30*b*, 30*c* and the fiber directions of the flexible sheets 37, 38, 39 intersect respectively. Vibration transmitted from the rod-like member 2 is spread out efficiently in directions intersecting with the fiber directions of the flexible sheets 37, 38, 39 (in the back-and-forth direction) via the vibration transmitters 30*a*, 30*b*, 30*c*. Vibration spread via the vibration transmitters 30*a*, 30*b*, 30*c* is further spread out in the fiber directions of the flexible sheets 37, 38, 39 (in the right-and-left direction). Consequently, in the speaker device according to the present embodiment, vibration tends to spread easily throughout the flexible sheets 37, 38, 39, and sound can be emitted from a broad region, leading to an improved sound quality.

Moreover, in the speaker device according to the present embodiment, since sound is generated from each of the three sound generators 3*a*, 3*b*, 3*c* having different shapes or curved surfaces from each other, a sound range can be expanded and directions of sound can be diversified.

Furthermore, in the speaker device according to the present embodiment, a part of the diaphragm 31*a* (the flexible sheet 37) of the first sound generator 3*a* functions as the vibration transmitter 30*a*. Accordingly, in the first sound generator 3*a*, the vibration transmitter 30*a* does not need to be included as a separate body.

Modified examples of the speaker device according to the present embodiment are explained hereinafter.

Combinations of the three sound generators 3*a*, 3*b*, 3*c* and the three grooves 20*a*, 20*b*, 20*c* in the speaker device according to the present embodiment are not limited to the combinations as described above and may be other combinations.

The speaker device according to the present embodiment may include any one or two of the three sound generators 3*a*, 3*b*, 3*c*.

The speaker device according to the present embodiment may further include the sound generator 3 of the first embodiment.

As explained above based on the attached figures, the speaker devices according to the first and the second embodiments include the vibration generator (1), the rod-like member (2), and the sound generator (3, 3*a*, 3*b*, 3*c*). The vibration generator (1) vibrates when receiving an electrical signal. The rod-like member (2) has a first longitudinal end fixed to the vibration generator (1). The sound generator (3, 3*a*, 3*b*, 3*c*) is attached to a part of the rod-like member (2). The sound generator (3, 3*a*, 3*b*, 3*c*) integrally includes the vibration transmitter (30, 30*a*, 30*b*, 30*c*) which has a fibrous structure and the diaphragm (31, 31*a*, 31*b*, 31*c*) which is a sheet and has a fibrous structure. The fiber direction of the vibration transmitter (30, 30*a*, 30*b*, 30*c*) and the fiber direction of the diaphragm (31, 31*a*, 31*b*, 31*c*) intersect with each other.

Accordingly, in the speaker devices according to the first and the second embodiments, vibration transmitted from the rod-like member (2) is spread out efficiently in the direction intersecting with the fiber direction of the sheet-shaped diaphragm (31, 31*a*, 31*b*, 31*c*) via the vibration transmitter (30, 30*a*, 30*b*, 30*c*). Vibration spread via the vibration transmitter (30, 30*a*, 30*b*, 30*c*) is further spread out in the fiber direction of the diaphragm (31, 31*a*, 31*b*, 31*c*). Consequently, in the speaker devices according to the first and the second embodiments, vibration tends to spread easily throughout the diaphragm (31, 31*a*, 31*b*, 31*c*), and sound can be emitted from a broad region, leading to an improved sound quality.

In addition, in the speaker devices according to the first and the second embodiments, the vibration transmitter (30, 30*a*, 30*b*, 30*c*) is positioned at a part of the sound generator (3, 3*a*, 3*b*, 3*c*). This part of the sound generator (3, 3*a*, 3*b*, 3*c*) is attached to the rod-like member (2).

Therefore, in the speaker devices according to the first and the second embodiments, vibration transmitted from the rod-like member (2) is transmitted quickly in the direction intersecting with the fiber direction of the sheet-shaped diaphragm (31, 31*a*, 31*b*, 31*c*) via the vibration transmitter (30, 30*a*, 30*b*, 30*c*). Consequently, in the speaker devices according to the first and the second embodiments, vibration is transmitted efficiently throughout the sound generator (3, 3*a*, 3*b*, 3*c*).

Further, in the speaker device according to the first embodiment, the diaphragm (31) includes the first flexible sheet (32) having a fibrous structure and the second flexible sheet (33) having a fibrous structure. The one end of the first flexible sheet (32) in the fiber direction thereof, the one end of the second flexible sheet (33) in the fiber direction thereof, and the vibration transmitter (30) are overlapping.

Therefore, in the speaker device according to the first embodiment, vibration transmitted from the rod-like member (2) is spread out throughout the one end of each of the first flexible sheet (32) and the second flexible sheet (33) in their respective fiber directions via the vibration transmitter (30). Vibration spread via the vibration transmitter (30) is further spread out in the fiber direction of each of the first flexible sheet (32) and the second flexible sheet (33). Consequently, in the speaker device according to the first embodiment, vibration can be spread out efficiently throughout each of the first flexible sheet (32) and the second flexible sheet (33).

Also, in the speaker device according to the second embodiment, the diaphragm (31*a*) includes the one flexible sheet (37) having a fibrous structure. The one part of the one flexible sheet (37) and the different part of the one flexible sheet (37) are overlapping such that the fiber direction of the one part of the one flexible sheet (37) and the fiber direction of the different part of the one flexible sheet (37) intersect with each other. The different part of the one flexible sheet (37) constitutes the vibration transmitter (30*a*).

Therefore, in the speaker device according to the second embodiment, the vibration transmitter (30*a*) does not need to be prepared separately from the diaphragm (31*a*), leading to a reduced amount of components. In the speaker device according to the second embodiment, positions and sizes of the parts of the one flexible sheet (37) which are overlapping with each other can be changed to adjust a sound range of emitted sound.

Moreover, in the speaker devices according to the first and the second embodiments, the flexible sheet (32, 33, 37, 38, 39) includes the pair of wooden sheets (34, 35) and the washi (36). The pair of wooden sheets (34, 35) is made of dried wood. The washi (36) is disposed between the pair of wooden sheets (34, 35) and bonded to each of the pair of wooden sheets (34, 35).

Accordingly, in the speaker devices according to the first and the second embodiments, since the pair of wooden sheets (34, 35) is reinforced with the washi (36), damages to the pair of wooden sheets (34, 35) due to vibration are suppressed. In the speaker devices according to the first and the second embodiments, damages to the pair of wooden sheets (34, 35) due to modification of the flexible sheet (32, 33, 37, 38, 39), are suppressed. In the speaker devices according to the first and the second embodiments, sound can be emitted from both of the front surface and the back surface of the flexible sheet (32, 33, 37, 38, 39).

Furthermore, in the speaker devices according to the first and the second embodiments, the rod-like member (2) is made of dried wood of which fiber direction corresponding to the longitudinal direction of the rod-like member (2). The sound generator (3, 3*a*) is attached to the second longitudinal end of the rod-like member (2).

Therefore, in the speaker devices according to the first and the second embodiments, vibration from the vibration generator (1) tends to easily be transmitted from the first longitudinal end to the second longitudinal end of the rod-like member (2). In the speaker devices according to the first and the second embodiments, the first longitudinal end of the rod-like member (2) serves as the fixed end and the second longitudinal end serves as the free end. The fixed end is fixed to the vibration generator (1), and the sound generator (3, 3*a*) is attached to the free end. Consequently, in the speaker devices according to the first and the second embodiments, vibration generated in the vibration generator (1) can be amplified by the rod-like member (2) and then transmitted to the sound generator (3, 3*a*).

The present invention is explained above based on the embodiments illustrated in the attached figures. However, the present invention is not limited to the above examples of the embodiments, and appropriate design changes can be made within an intended scope of the present application.

The invention claimed is:

1. A speaker device comprising:

a vibration generator which vibrates when receiving an electrical signal;

a rod-like member having its first longitudinal end fixed to the vibration generator; and a sound generator attached to a part of the rod-like member, the sound generator integrally including:

a vibration transmitter which has a fiber structure; and a diaphragm which is a sheet and has a fiber structure, the vibration transmitter being a wooden thin plate which has a fiber structure, the diaphragm including a first flexible sheet having a fiber structure and a second flexible sheet having a fiber structure, each of the first flexible sheet and the second flexible sheet including a pair of wooden sheets and a washi which is a piece of Japanese paper, each of the pair of wooden sheets being made of dried wood; and the washi being disposed between the pair of wooden sheets and bonded to each of the pair of wooden sheets, when a fiber direction is defined as a direction in which fibers of a fiber structure are oriented, one end of the first flexible sheet in a fiber direction thereof, one end of the second flexible sheet in a fiber direction thereof and the thin plate being overlapping such that the fiber direction of the first flexible sheet and a fiber direction of the thin plate intersect with each other and the fiber direction of the second flexible sheet and the fiber direction of the thin plate intersect with each other, and a part of the sound generator where the first flexible sheet, the second flexible sheet and the thin plate are overlapping being attached to the rod-like member.

2. A speaker device comprising:

a vibration generator which vibrates when receiving an electrical signal;

a rod-like member having its first longitudinal end fixed to the vibration generator; and a sound generator attached to a part of the rod-like member, the sound generator integrally including:

a vibration transmitter which has a fiber structure; and a diaphragm which is a sheet and has a fiber structure, the diaphragm including one flexible sheet having a fiber structure, the one flexible sheet including a pair of wooden sheets and a washi which is a piece of Japanese paper, each of the pair of wooden sheets being made of dried wood, and the washi being disposed between the pair of wooden sheets and bonded to each of the pair of wooden sheets, when a fiber direction is defined as a direction in which fibers of a fibrous structure are oriented, a part of the one flexible sheet and another part of the one flexible sheet being overlapping such that a fiber direction of the part of the one flexible sheet and a fiber direction of the another part of the one flexible sheet intersect with each other, the another part of the one flexible sheet constitutes the vibration transmitter, and a part of the sound generator where the part of the one flexible sheet and the another part of the one flexible sheet are overlapping being attached to the rod-like member.

3. The speaker device according to claim 1, wherein:

the rod-like member is made of dried wood;

a fiber direction of the rod-like member is a longitudinal direction of the rod-like member; and the sound generator is attached to a second longitudinal end of the rod-like member.

4. The speaker device according to claim 2, wherein:

the rod-like member is made of dried wood;

a fiber direction of the rod-like member is a longitudinal direction of the rod-like member; and the sound generator is attached to a second longitudinal end of the rod-like member.

5. The speaker device according to claim 1, wherein:

the fiber direction of the thin plate is a longitudinal direction thereof, the fiber directions of the first flexible sheet and the second flexible sheet are longitudinal directions of the first flexible sheet and the second flexible sheet, respectively; and the thin plate is disposed between a longitudinal one end of the first flexible sheet and a longitudinal one end of the second flexible sheet such that the fiber direction of the first flexible sheet and the fiber direction of the thin plate intersect with each other and the fiber direction of the second flexible sheet and the fiber direction of the thin plate intersect with each other.

6. The speaker device according to claim 5, wherein:

the thin plate overlaps the first flexible sheet over a whole length in a transverse direction of the first flexible sheet; and the thin plate overlaps the second flexible sheet over a whole length in a transverse direction of the second flexible sheet.

7. The speaker device according to claim 1, wherein:

a thickness of the thin plate is 0.2 to 2.0 mm.

8. The speaker device according to claim 1, wherein:

the thin plate is made of solid wood.

9. The speaker device according to claim 2, wherein:

the fiber direction of the one flexible sheet is a longitudinal direction of the one flexible sheet, a longitudinal one part of the one flexible sheet and a longitudinal different part of the one flexible sheet are overlapping such that a fiber direction of the longitudinal one part of the one flexible sheet and a fiber direction of the longitudinal different part of the one flexible sheet intersect with each other, and the one flexible sheet has a cylindrical shape.

10. The speaker device according to claim 9, wherein:

the longitudinal one part of the one flexible sheet is a first region at one longitudinal end of the one flexible sheet, and the longitudinal different part of the one flexible sheet is a second region at the other longitudinal end of the one flexible sheet.

* * * * *